US011804352B2

(12) United States Patent
Osada

(10) Patent No.: US 11,804,352 B2
(45) Date of Patent: Oct. 31, 2023

(54) FUSE

(71) Applicant: PACIFIC ENGINEERING CORPORATION, Ogaki (JP)

(72) Inventor: Kenji Osada, Ogaki (JP)

(73) Assignee: Pacific Engineering Corporation, Ogaki (JP)

( * ) Notice: Subject to any disclaimer, the term of this patent is extended or adjusted under 35 U.S.C. 154(b) by 0 days.

(21) Appl. No.: 17/289,163

(22) PCT Filed: Sep. 26, 2019

(86) PCT No.: PCT/JP2019/037787
§ 371 (c)(1),
(2) Date: Apr. 27, 2021

(87) PCT Pub. No.: WO2020/137056
PCT Pub. Date: Jul. 2, 2020

(65) Prior Publication Data

US 2021/0407757 A1 Dec. 30, 2021

(30) Foreign Application Priority Data

Dec. 28, 2018 (JP) ..... 2018-246708

(51) Int. Cl.
*H01H 85/12* (2006.01)
*H01H 85/147* (2006.01)
(Continued)

(52) U.S. Cl.
CPC ..... *H01H 85/147* (2013.01); *H01H 85/08* (2013.01); *H01H 85/10* (2013.01); *H01H 85/12* (2013.01)

(58) Field of Classification Search
CPC .. H01H 85/10; H01H 85/147; H01H 85/1755; H01H 2085/208; H01H 85/08–12
See application file for complete search history.

(56) References Cited

U.S. PATENT DOCUMENTS 3,714,613 A * 1/1973 Appleton ..... H01H 85/10 337/159
3,935,553 A * 1/1976 Kozacka ..... H01H 85/10 337/296

(Continued)

FOREIGN PATENT DOCUMENTS

JP 91836/1983 U 6/1983
JP 2014-154234 A 8/2014
JP 2017-4634 A 1/2017

OTHER PUBLICATIONS

Japanese Patent Office; International Search Report dated Nov. 19, 2019; PCT Patent Application No. PCT/JP2019/037787; pp. 1-2 (2019).

*Primary Examiner* — Jacob R Crum
(74) *Attorney, Agent, or Firm* — FisherBroyles LLP; Kevin D. Jablonski

(57) ABSTRACT

The present invention provides a fuse that has a stable fusing characteristic and is easily manufactured.

A fuse 600 includes: a fuse element 100 that is provided between a pair of terminal parts 110 and has a plurality of fuse parts 120; and a casing 200 for housing the fuse parts 120, wherein the fuse element 100 includes a first flat surface 140 and a second flat surface 150 which are shaped bent along a longitudinal direction P of the fuse element 100 and which extend in a linear manner along the longitudinal direction P, wherein the first flat surface 140 and the second flat surface 150 are provided with the plurality of fuse parts 120, and wherein the first flat surface 140 and the second flat surface 150 are contiguous to one other via a bent section 131.

10 Claims, 8 Drawing Sheets

(51) Int. Cl.
*H01H 85/10* (2006.01)
*H01H 85/08* (2006.01)

(56) References Cited

U.S. PATENT DOCUMENTS

| | | | | | |
|---|---|---|---|---|---|
| 5,055,817 | A * | 10/1991 | O'Shields | H01H 85/08 | 337/161 |
| 5,296,832 | A * | 3/1994 | Perreault | H01H 85/153 | 337/201 |
| 5,736,918 | A | 4/1998 | Douglass | | |
| 2003/0045167 | A1* | 3/2003 | Douglas | H01H 85/08 | 439/620.29 |
| 2013/0009744 | A1* | 1/2013 | Douglass | H01H 85/15 | 337/187 |
| 2014/0118888 | A1* | 5/2014 | Depp | H01H 50/021 | 361/626 |
| 2015/0348731 | A1* | 12/2015 | Douglass | H01H 85/10 | 337/198 |
| 2015/0348732 | A1* | 12/2015 | Douglass | H01H 85/175 | 337/198 |
| 2015/0371803 | A1* | 12/2015 | Hosomizo | H01H 85/12 | 337/142 |

* cited by examiner

FUSE

TECHNICAL FIELD

The present invention mainly relates to a fuse which is used in an electric circuit for an automobile or an electric circuit of an infrastructure or the like, and particularly relates to a fuse that houses a fuse element in a casing.

BACKGROUND ART

Conventionally, a fuse has been used to protect an electric circuit which is installed in an automobile, an infrastructure or the like and various electrical components which are connected to the electric circuit. More precisely, when an unintended overcurrent flows in an electric circuit, a fuse part of a fuse element built into the fuse melts under the heat generated by the overcurrent, thereby protecting the various electrical components by preventing excess current from flowing.

Further, various types of such fuses exist depending on the application, and the fuse disclosed in Patent Literature 1 for protection from comparatively large overcurrent has been known, for example.

The fuse disclosed in Patent Literature 1 is of the type that houses a fuse element inside a cylindrical casing and includes a fuse element which has a pair of terminal parts and a fuse part provided between the terminal parts. The fuse element is bent in a direction in which the overall length of the fuse element contracts and has a wave-like shape in a side elevation.

However, when the fuse element has a wave-like shape, the distance between the fuse parts provided in a plurality to the fuse element is then short, and there has been the problem that fuse parts which are close to one another exert an electrical or thermal effect on one another and degradation of the fusing characteristic occurs. In addition, because the fuse element is bent like a wave, deformation of the fuse element readily occurs due to an external force or the like which acts when the fuse is being manufactured. Hence, there has been the problem that the position and orientation of the fuse element in the casing are difficult to stabilize and that the fusing characteristic is reduced.

CITATIONS LIST

Patent Literature

Patent Literature 1: Japanese Laid-open Patent Application No. 2018-26202.

SUMMARY OF INVENTION

Technical Problems

Therefore, the present invention provides a fuse that has a stable fusing characteristic and is easily manufactured.

Solutions to Problems

In order to solve the foregoing problem, a fuse of the present invention is a fuse including: a fuse element that is provided between a pair of terminal parts and has a plurality of fuse parts; and a casing for housing the fuse parts, wherein the fuse element includes a first flat surface and a second flat surface which are shaped bent along a longitudinal direction of the fuse element and which extend in a linear manner along the longitudinal direction, wherein the first flat surface and the second flat surface are provided with the plurality of fuse parts, and wherein the first flat surface and the second flat surface are contiguous to one another via a bent section of the fuse element.

According to the foregoing feature, because the plurality of fuse parts provided to the first and second flat surfaces are arranged in a linear manner, adjacent fuse parts are not close to one another, thereby preventing fuse parts from exerting an electrical or thermal effect on one another and degradation of the fusing characteristic. In addition, the first flat surface and second flat surface, which extend in a linear manner along the longitudinal direction, are contiguous to each another via a bent section along the longitudinal direction of the fuse element, and hence the first flat surface and second flat surface are shaped so as to be bent substantially in an L shape, thereby enhancing rigidity. As a result, deformation of the fuse element due to an external force or the like which acts when the fuse is being manufactured can be prevented, and the fuse can be easily manufactured. Furthermore, by enhancing the rigidity of the fuse element, the position and orientation of the fuse element in the casing are stabilized and hence the fusing characteristic is also stable.

Further, according to the fuse of the present invention, the fuse element is shaped bent toward the center of the casing.

According to the foregoing feature, the fuse parts are disposed further toward the center of the casing than the inner wall of the casing, and it is thus difficult for an arc generated by a fuse part to reach the inner wall of the casing; as a result, damage to the casing can be prevented. In addition, because the fuse parts are arranged near the center of the casing, the arc generated by the fuse part can be extinguished effectively by an arc-extinguishing material.

Furthermore, according to the fuse of the present invention, the fuse parts are provided to each of the first flat surface and the second flat surface such that the bent section is sandwiched between the fuse parts.

According to the foregoing feature, the fuse parts, which are provided to each of the first and second flat surfaces such that the bent section is sandwiched between the fuse parts, may be close to the center of the casing. As a result, an arc generated by a fuse part can be extinguished effectively by an arc-extinguishing material.

Furthermore, according to the fuse of the present invention, the fuse element is constituted from a flat metal plate, and the first flat surface and the second flat surface are formed by being bent along the longitudinal direction of the fuse element.

According to the foregoing feature, the first flat surface and the second flat surface, which are molded bent from a metal plate, have enhanced rigidity and are easy to manufacture.

Advantageous Effects of Invention

As mentioned earlier, the fuse of the present invention has a stable fusing characteristic and is easy to manufacture.

BRIEF DESCRIPTION OF DRAWINGS

FIG. 1(*b*) is a plan view of a state where the fuse element is molded bent; FIG. 1(*c*) is a front elevation of the fuse element in said state; and FIG. 1(*d*) is a side elevation of the fuse element in said state.

FIG. 6(*b*) is a perspective view of a state in which the fuse element is molded bent; and FIG. 6(*c*) is an overall perspective view of a casing for housing the fuse element.

FIG. 8(*c*) is an overall perspective view of a finished fuse according to the second embodiment of the present invention.

REFERENCE SIGNS LIST

Figure 1A:
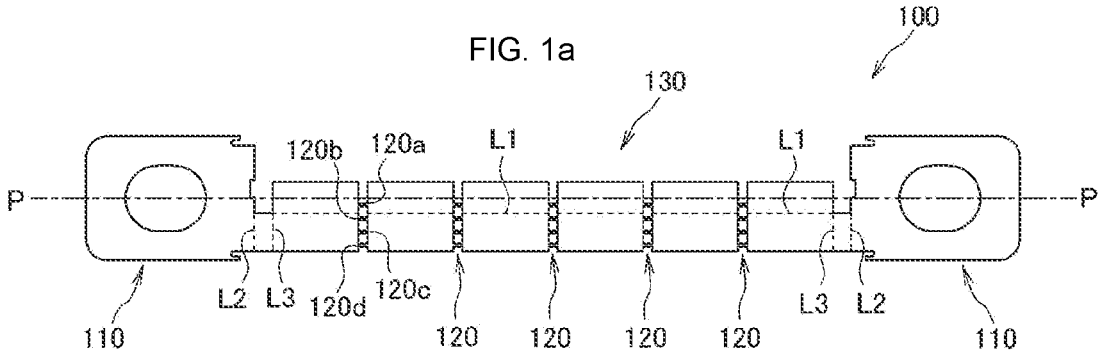
FIG. 1(*a*) is a plan view of a state where a fuse element according to the first embodiment of the present invention is expanded.
Figure 1B:
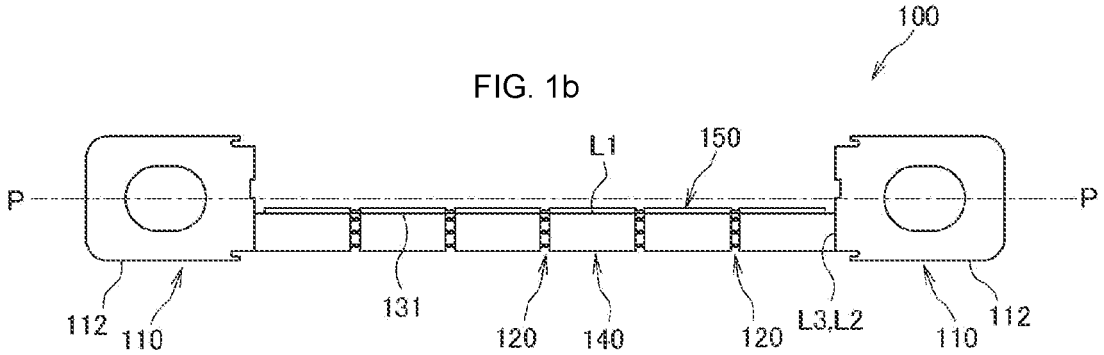
Figure 1C:
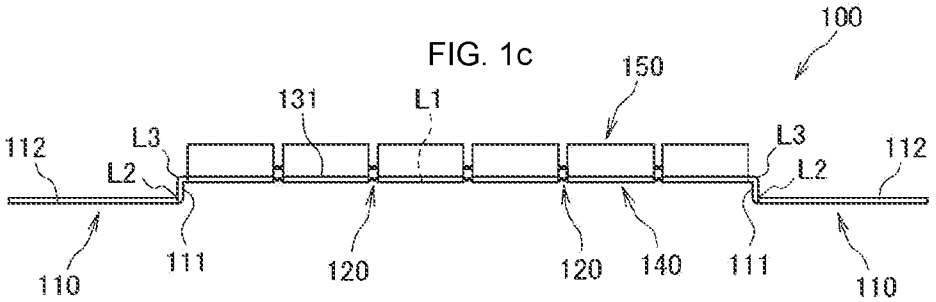
Figure 1D:
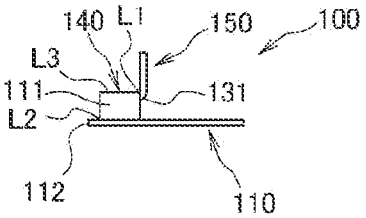

100 Fuse element
110 Terminal part
120 Fuse part
131 Bent section
140 First flat surface
150 Second flat surface
200 Casing
600 Fuse
P Longitudinal direction

DESCRIPTION OF EMBODIMENTS

Embodiments of the present invention will be described hereinbelow using the drawings. Note that the shape and material properties and the like of each member of a fuse according to the embodiments described hereinbelow are illustrative examples and the present invention is not limited to or by such shapes and material properties and the like. Note that the "longitudinal direction of the fuse element" disclosed in this specification is a direction parallel to an axis linking the terminal parts at both ends of the fuse element. Furthermore, "up-down direction" denotes a direction perpendicular to the longitudinal direction of the fuse element.

First Embodiment

FIG. 1 illustrates the process of manufacturing a fuse element 100 of a fuse according to a first embodiment of the present invention. Note that FIG. 1(*a*) is a plan view of a state where the fuse element 100 is expanded; FIG. 1(*b*) is a plan view of a state where the fuse element 100 is molded bent; FIG. 1(*c*) is a front elevation of the fuse element 100 in said state; FIG. 1(*d*) is a side elevation of the fuse element 100 of said state; and FIG. 2 is an overall perspective view of the fuse element 100.

First, a flat plate of uniform thickness formed from a conductive metal such as copper or a copper alloy is stamped using a press machine or the like into the shape illustrated in FIG. 1(*a*). A metal plate made in a predetermined shape as illustrated in FIG. 1(*a*) are formed with a terminal part 110 at both ends, a flat middle section 130 between the terminal parts 110, and a plurality of fuse parts 120. Describing same in specific terms, the fuse part 120 is constituted from a fuse part 120*a*, a fuse part 120*b*, a fuse part 120*c*, and a fuse part 120*d* which form a line with a locally narrower width in the middle section 130, and when an unintended overcurrent flows in an electric circuit or the like, the fuse parts (120*a* to 120*d*) each melt under heat generation so as to interrupt the overcurrent. Note that the fuse parts 120 are not limited to being constituted from fuse parts (120*a* to 120*d*) in the form of a line of narrow width, rather, as long as the fuse parts melt under heat generation so as to interrupt the overcurrent when an unintended overcurrent flows in an electric circuit or the like, the configuration may be such that small holes are provided in the middle section 130 and the fuse parts 120 are sections of narrow width, or any configuration may be adopted such as a configuration in which a metallic material that readily melts is disposed locally in the middle section 130.

Figure 2:
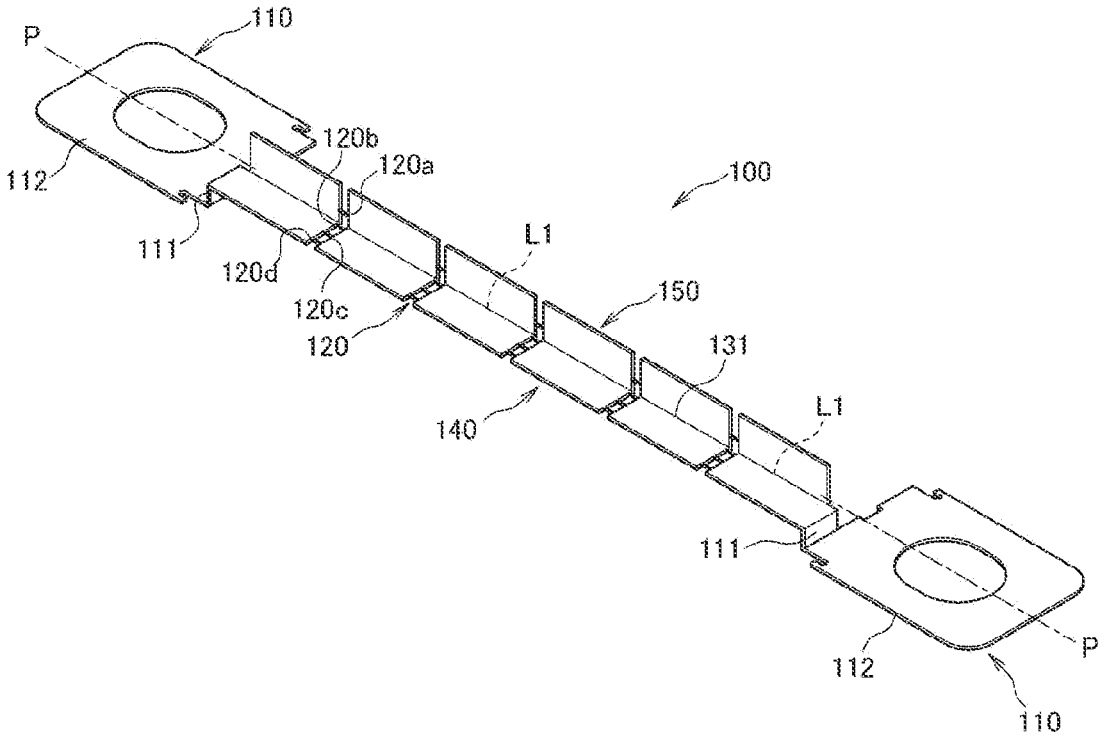
FIG. 2 is an overall perspective view of the fuse element according to the first embodiment of the present invention.

Next, as illustrated in FIGS. 1(*b*) to 1(*d*) and FIG. 2, the middle section 130 is bent at a fold line L1 which is parallel to the longitudinal direction P of the fuse element 100. Note that the longitudinal direction P of the fuse element 100 is a direction parallel to an axis linking the terminal parts 110 at both ends. Hence, the fold line L1 is also parallel to the axis linking the terminal parts 110 at both ends.

Thus, the middle section 130 includes a first flat surface 140 which extends in a linear manner along the longitudinal direction P; and a second flat surface 150 which bends so as to rise from the first flat surface 140 and extends in a linear manner along the longitudinal direction P. The first flat surface 140 and the second flat surface 150 are contiguous to one other via a bent section 131 which is bent at the fold line L1, and the first flat surface 140 and the second flat surface 150 intersect substantially at right angles to one another. A state thus results where a plurality of fuse parts 120 are provided on the first flat surface 140 and the second flat surface 150. More specifically, the fuse part 120*a* is provided on the second flat surface 150, and the fuse part 120*b*, the fuse part 120*c*, and the fuse part 120*d* are provided on the first flat surface 140.

In addition, the point where the terminal part 110 is coupled to the middle section 130 is bent in a direction orthogonal to the longitudinal direction P at fold lines L2 and L3. Thus, a step part 111 which is bent in a direction orthogonal to the longitudinal direction P is formed between the first flat surface 140 and the terminal part 110. The step part 111 is constituted so that, when the first flat surface 140 is stretched along the longitudinal direction P due to heat generation during conduction of an overcurrent, stress caused by the stretching can be absorbed by the step part deforming such that the flexion angle at fold lines L2 and L3 changes. Furthermore, the whole fuse element 100, that is, the terminal part 110, the first flat surface 140, and the second flat surface 150 are integrally molded from a flat metal plate.

Moreover, as illustrated in FIG. 1(*d*), the first flat surface 140 and second flat surface 150 are arranged displaced laterally from the center of the fuse element 100. In other words, the first flat surface 140 and second flat surface 150 are arranged displaced closer to a side end 112 than the center of the terminal part 110. In addition, the first flat surface 140 and second flat surface 150 are arranged displaced above the terminal part 110 due to the step part 1*l*1. Hence, as described subsequently, when a plurality of fuse elements 100 are housed in a casing 200, the first flat surface 140 and second flat surface 150 of each of the fuse elements 100 can be prevented from interfering with each other.

Next, a method for assembling a fuse 600 of the present invention will be described with reference to FIGS. 3 and 4. Note that FIGS. 3(*a*) and 3(*b*) are overall perspective views of a state where a plurality of fuse elements 100 are combined; FIG. 4(*a*) is an overall perspective view in which the respective members constituting the fuse 600 are illustrated in an exploded view; and FIG. 4(*b*) is an overall perspective view of the finished fuse 600.

Figure 3A:
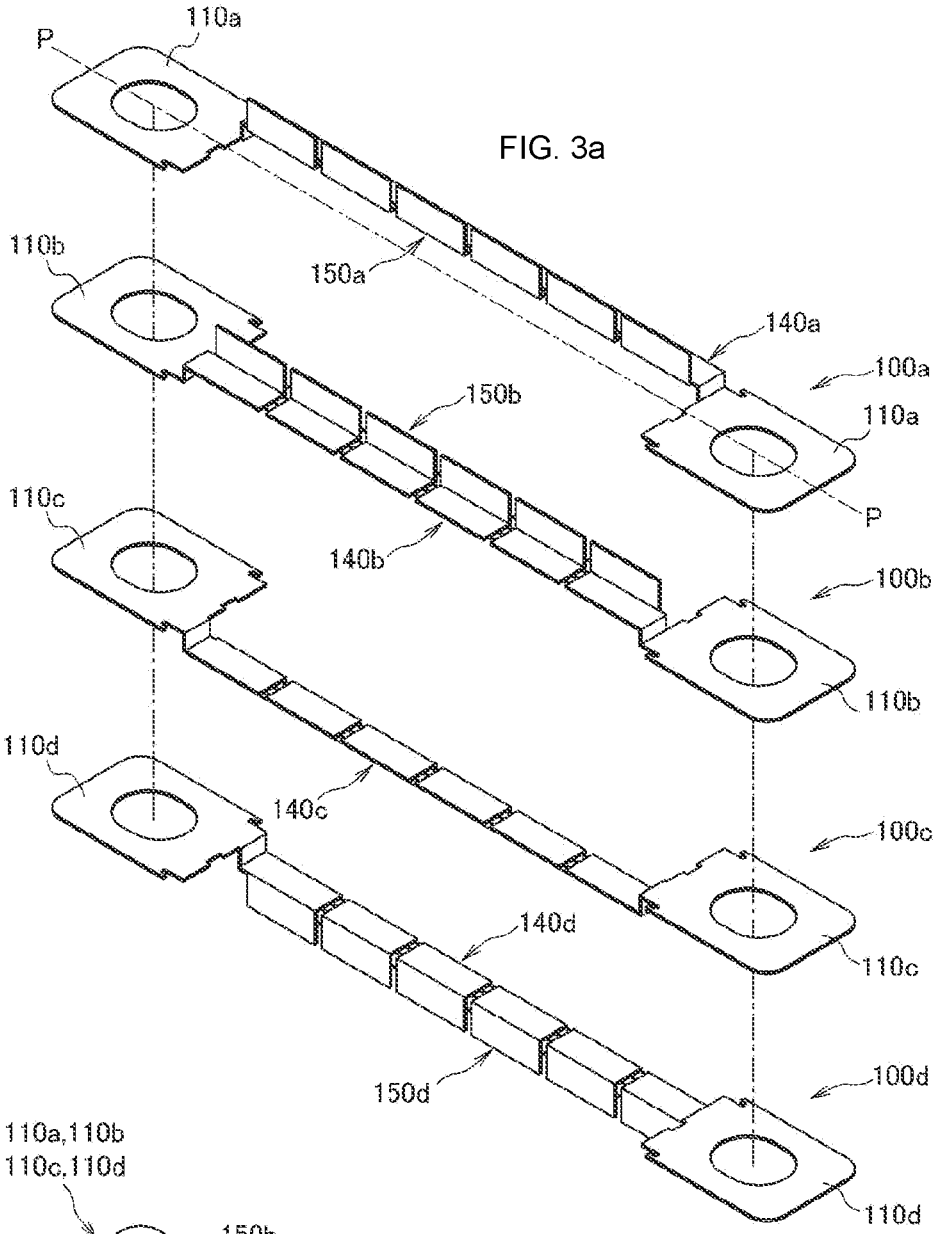
FIGS. 3(*a*) and 3(*b*) are overall perspective views of a state where a plurality of the fuse element according to the first embodiment of the present invention are combined.
Figure 3B:
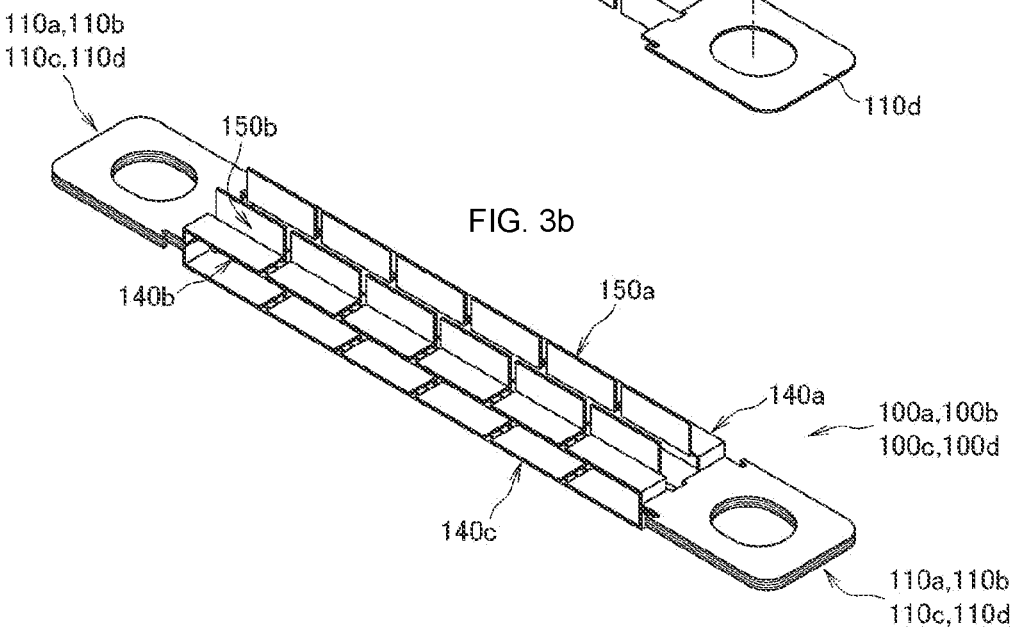
Figure 4A:
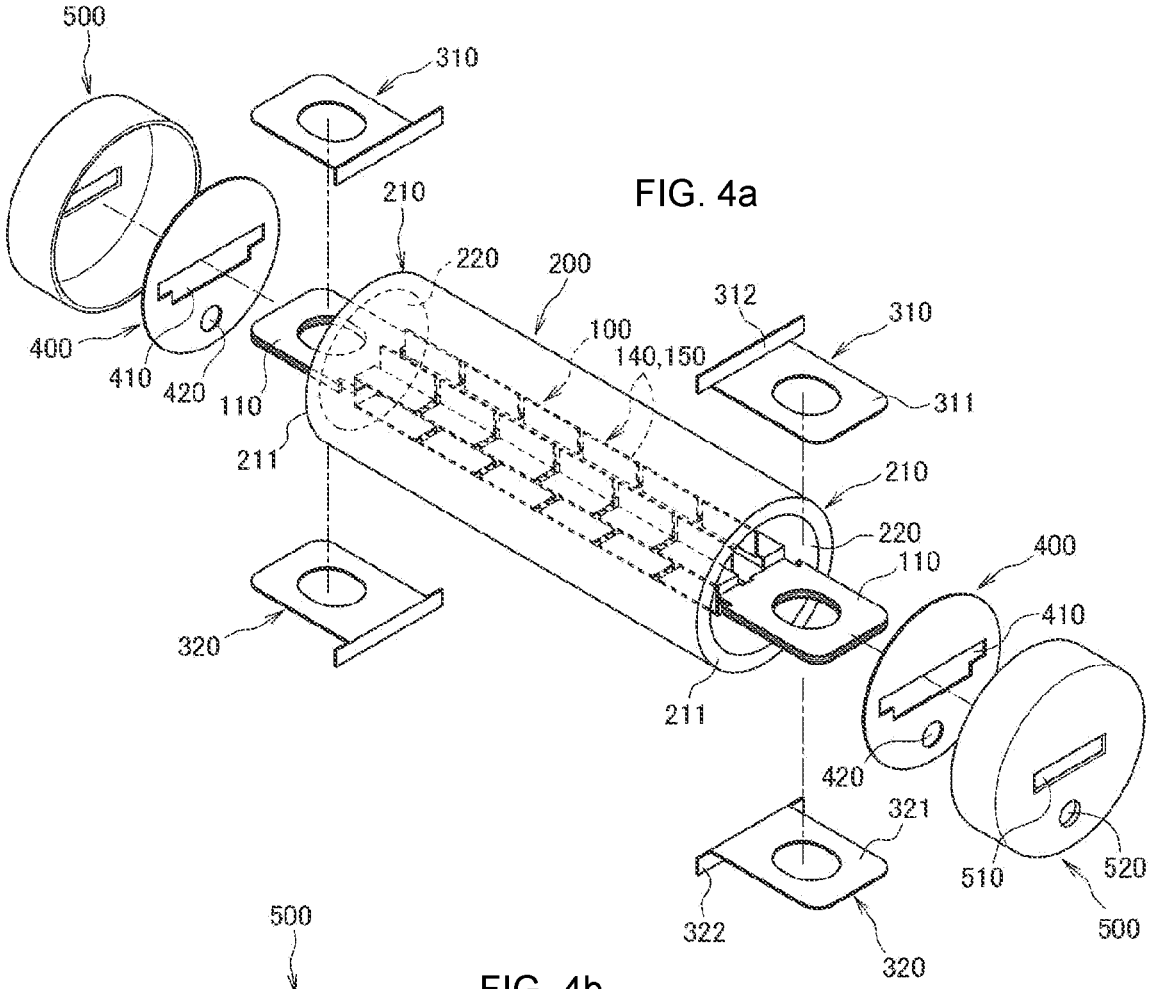
FIG. 4(*a*) is an overall perspective view in which the respective members constituting the fuse according to the first embodiment of the present invention are illustrated in an exploded view, and FIG. 4(*b*) is an overall perspective view of a finished fuse.
Figure 4B:
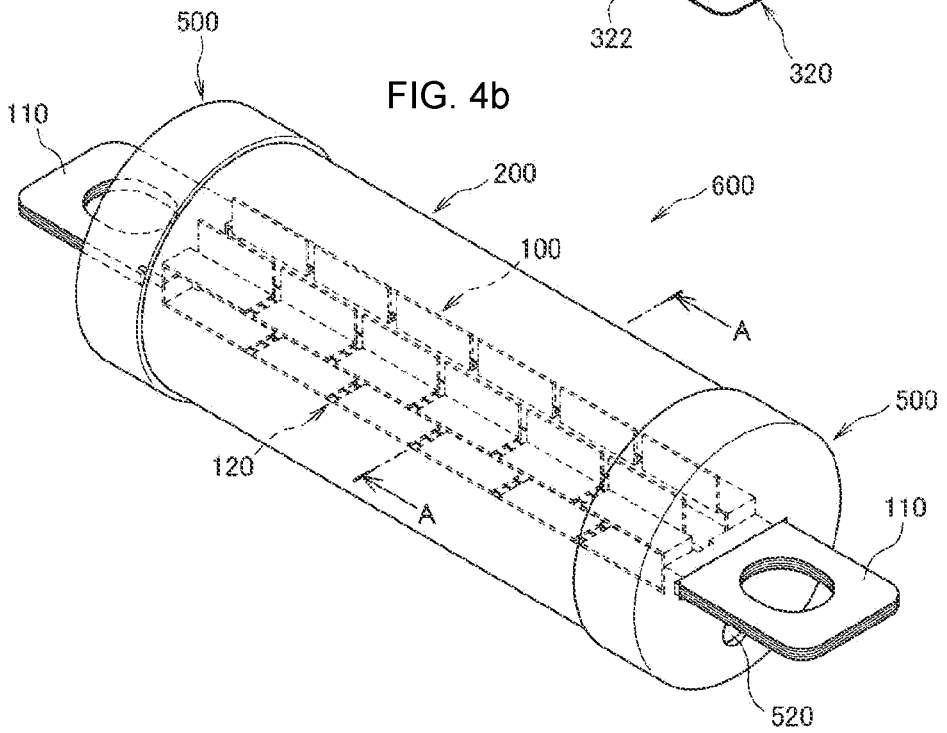

As illustrated in FIG. 3(*a*), four fuse elements 100 are first prepared and overlapped with orientations which are obtained by inverting the fuse elements 100 vertically and horizontally. Here, in order to discriminate between each of the fuse elements 100, same are denoted, starting from the top, as a fuse element 100*a*, a fuse element 100*b*, a fuse element 100*c*, and a fuse element 100*d*.

Further, the fuse element 100*b* is oriented so as to be horizontally inverted relative to the fuse element 100*a*. In other words, the orientation of the fuse element 100*b* is obtained by rotating the fuse element 100*a* through 180 degrees in a horizontal plane such that one terminal part 100*a* of the fuse element 100*a* in the drawing foreground is positioned on the other terminal part 110*a* in the drawing background. Further, the terminal part 110*b* of a fuse element 100*b* is disposed stacked below the terminal part 110*a* of the fuse element 100*a*.

Next, the fuse element 100*c* is oriented so as to be vertically inverted relative to the fuse element 100*a*. In other words, the orientation of the fuse element 100*c* is obtained by rotating the fuse element 100*a* through 180 degrees about an axis P1 along the longitudinal direction thereof. Further, the terminal part 110*c* of the fuse element 100*c* is disposed stacked below the terminal part 110*b* of the fuse element 100*b*.

Further, the fuse element 100*d* is oriented so as to be horizontally inverted relative to the fuse element 100*c*. In other words, the orientation of the fuse element 100*d* is obtained by rotating the fuse element 100*c* through 180 degrees in a horizontal plane such that one terminal part 110*c* of the fuse element 100*c* in the drawing foreground is positioned on the other terminal part 110*c* in the drawing background. Further, the terminal part 110*d* of a fuse element 100*d* is disposed stacked below the terminal part 110*c* of the fuse element 100*c*. Thus, as illustrated in FIG. 3(*b*), the first flat surfaces (140*a* to 140*d*) and the second flat surfaces (150*a* to 150*d*) of the respective fuse elements (100*a* to 100*d*) are arranged compactly without interfering with one another.

Next, as illustrated in FIG. 4(*a*), the respective fuse elements 100 in a stacked state are inserted into the casing 200 via openings 220 at ends 210 thereof. The casing 200 has a cylindrical shape which is formed from ceramic or a synthetic resin or the like, and includes the openings 220 in the ends 210 on both sides. Further, the casing 200 has a length that enables the first flat surface 140 and second flat surface 150 of the fuse element 100 to be housed therein, and the terminal parts 110 of the fuse element 100 are in a state of protruding from the openings 220 on both sides of the casing 200.

Next, the holding piece 310 and holding piece 320, which are made of metal, are attached to the terminal parts 110 protruding from the openings 220 of the casing 200 so as to pinch the terminal parts 110 from above and below. The holding piece 310 includes a gripping piece 311 of the same shape as the terminal part 110 and a locking part 312 which is provided so as to rise from the gripping piece 311. Further, the gripping piece 311 is fixed to the terminal part 110 through screwing, welding or the like. Similarly, the holding piece 320 includes a gripping part 321 of the same size as the terminal part 110 and a locking part 322 which is provided so as to rise from the gripping part 321. Further, the gripping part 321 is fixed to the terminal part 110 through screwing, welding or the like. In addition, because the widths of the locking parts 312 and 322 are longer than the width of the openings 220 of the casing 200, the locking parts 312 and 322 lock onto an edge 211 around the openings 220. Therefore, the locking part 312 of the holding piece 310 and the locking part 322 of the holding piece 320 which are fixed to the terminal part 110 on both sides of the fuse element 100 lock onto the edge 211 on both sides of the casing 200, and hence the fuse elements 100 do not fall out from inside the casing 200 and are in a state of being held inside the casing 200.

Next, lid plates 400 made of metal or a synthetic resin are attached so as to cover the openings 220 of the casing 200. The lid plates 400 have a disc shape which is larger than the openings 220 to enable the openings 220 to be covered, and include a long hole 410 enabling insertion of the terminal parts 110. Furthermore, the lid plates 400 also include a hole 420 to enable granular arc-extinguishing material, described subsequently, to flow into the openings 220. Further, after the lid plates 400 have been attached to cover the openings 220 of the casing 200, caps 500 made of metal or a synthetic resin are attached so as to cover the ends 210 of the casing 200. The caps 500 have a cylindrical shape which is larger than the ends 210 to enable fitting to the outside of the ends 210, and include along hole 510 enabling insertion of the terminal parts 110 and a hole 520 that overlaps the hole 420.

When the caps 500 are attached so as to cover the ends 210 of the casing 200, a fuse 600 is finished as illustrated in FIG. 4(*b*). Note that the holes 520 of the fuse 600 are closed after the arc-extinguishing material has flowed via the holes 520 into the casing 200, thereby encapsulating the arc-extinguishing material inside the casing 200. Further, the fuse 600 is used such that, when a portion of the electric circuit is electrically connected to the terminal parts 110 protruding from the caps 500 and an unintended overcurrent flows in the electric circuit, the fuse parts 120 of the fuse element 100 melt and interrupt the overcurrent, thereby protecting the electric circuit.

Thus, the fuse 600 of the present invention includes a first flat surface 140 and a second flat surface 150 which extend in a linear manner along the longitudinal direction, and a plurality of fuse parts 120 provided on the first flat surface 140 and second flat surface 150 are arranged in a linear manner, as illustrated in FIG. 1. Hence, adjacent fuse parts 120 are not close to one another, thereby preventing fuse parts from exerting an electrical or thermal effect on one another and degradation of the fusing characteristic.

In addition, the first flat surface 140 and second flat surface 150 which extend in a linear manner along the longitudinal direction are contiguous to one another in the sections thereof which are bent along the longitudinal direction of the fuse element 100. Therefore, the first flat surface 140 and second flat surface 150 of the fuse element 100 are shaped so as to be bent substantially in an L shape, thereby enhancing rigidity. In particular, because the first flat surface 140 and second flat surface 150 extend in a linear manner along the longitudinal direction, there is the problem that same readily bend individually and have low rigidity, but said problem is solved when the first flat surface 140 and second flat surface 150 are contiguous to one another via the bent section 131 of the fuse element 100 and are substantially L-shaped. Therefore, when the rigidity of the fuse element 100 is high, the fuse element 100 can be prevented from deforming due to an external force or the like which acts when the fuse 600 is being manufactured, thereby facilitating manufacturing of the fuse 600. Furthermore, by enhancing the rigidity of the fuse element 100, the position and orientation of the fuse element 100 in the casing 200 are stabilized and hence the fusing characteristic is also stable.

Note that the fuse element 100 of the fuse 600 of the present invention may have a bent shape toward the center O of the casing 200 as described subsequently with reference to FIG. 5, that is, the fuse element 100 may have a shape in which the bent section 131 is disposed toward the center O of the casing 200, but is not limited thereto and may have a shape bent toward an inner wall 201 of the casing 200, that is, the fuse element 100 may have a shape in which the bent section 131 is disposed toward the inner wall 201 of the casing 200. In this case also, because the first flat surface 140 and second flat surface 150 of the fuse element 100 are shaped so as to be bent substantially in an L shape, rigidity is enhanced, and the fuse element 100 can be prevented from deforming due to an external force or the like which acts when the fuse 600 is being manufactured, thereby facilitating manufacturing of the fuse 600. In addition, the position and orientation of the fuse element 100 in the casing 200 are stabilized, and the fusing characteristic is also stable.

Furthermore, as illustrated in FIG. 1, the fuse element 100 of the fuse 600 of the present invention is constituted from a flat metal plate, and the first and second flat surfaces are formed by being bent along the longitudinal direction P of the fuse element 100. Hence, the rigidity of the first flat surface 140 and second flat surface 150, which are molded bent from the metal plate, is enhanced and manufacture thereof is also straightforward.

Note that, although the fuse element 100 of the fuse 600 of the present invention is constituted from a flat metal plate in FIG. 1, same is not limited to this configuration, rather, the whole fuse element 100 may also be manufactured by preparing the integrally molded first flat surface 140 and second flat surface 150 and coupling the terminal part 110, which is separate from the first flat surface 140 and second flat surface 150, to the first flat surface 140 through welding or the like. The whole fuse element 100 may also be manufactured by individually manufacturing all of the terminal part 110, first flat surface 140, and second flat surface 150 and then coupling the same to one another through welding or the like. In a case where the first flat surface 140 and second flat surface 150 are manufactured individually, the first flat surface 140 and second flat surface 150 are subsequently coupled substantially at right angles to one another through welding or the like, the coupling point thereof being the bent section 131 of the fuse element 100.

Furthermore, as illustrated in FIG. 3, although four fuse elements 100 are housed in the casing 200 in the case of the fuse 600 of the present invention, the same is not limited to such a configuration, rather, only one fuse element 100 may be housed in the casing 200 or any number of two or more fuse elements 100 may be housed therein.

Next, the internal structure of the fuse 600 of the present invention will be described with reference to FIG. 5. Note that FIG. 5 is a cross-sectional view along A-A in FIG. 4(*b*).

Figure 5:
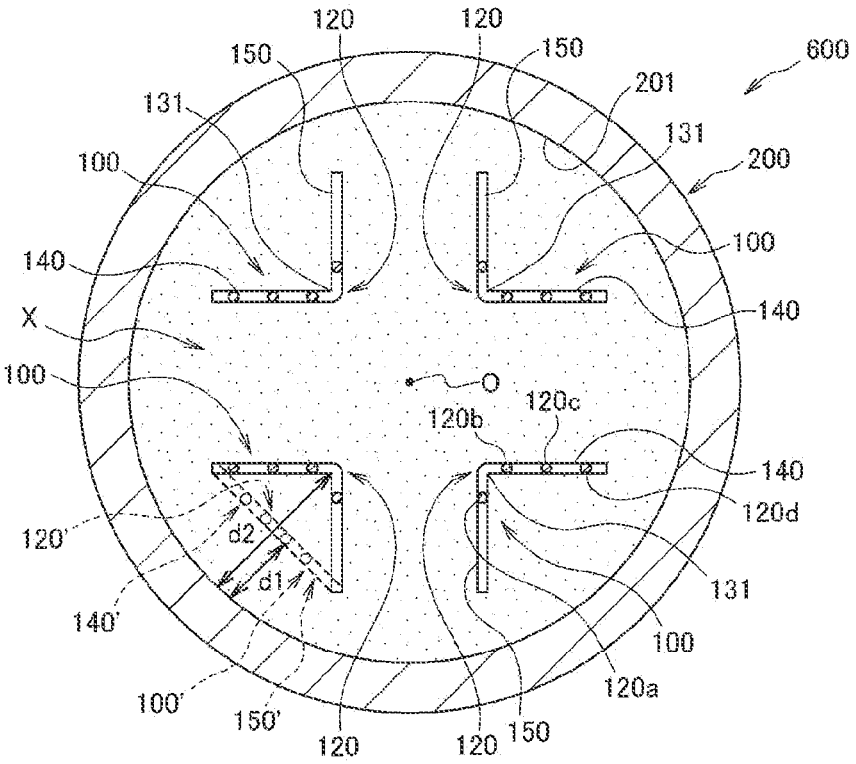
FIG. 5 is a cross-sectional view along A-A in FIG. 4(*b*).

As illustrated in FIG. 5, the four fuse elements 100 housed in the casing 200 of the fuse 600 are each arranged around the center O of the casing 200. Furthermore, the bent section 131 of the fuse elements 100 is disposed toward the center O of the casing 200. That is, the fuse elements 100 are shaped bent toward the center O of the casing 200. Hence, the fuse parts 120 provided to the first flat surface 140 and second flat surface 150 are arranged closer to the center O of the casing 200 than the inner wall 201 of the casing 200.

Here, assuming a case where the fuse elements 100 are not bent and the first flat surface 140 and second flat surface 150 are contiguous in a linear manner, FIG. 5 illustrates, using an imaginary line, a fuse element 100' in which a first flat surface 140' and a second flat surface 150' are contiguous in a linear manner. A fuse part 120' is provided to the first flat surface 140' and second flat surface 150' of the fuse element 100', the fuse part 120' being adjacent to the inner wall 201 of the casing 200. Further, although the fuse part 120' of the fuse element 100' melts and interrupts the overcurrent when an unintended overcurrent flows in an electric circuit or the like, an arc may be generated subsequently in the vicinity of the melted fuse part 120'. Nevertheless, the fuse part 120' is close to the inner wall 201 of the casing 200, and hence an arc which is generated by the fuse part 120' easily reaches the inner wall 201 of the casing 200 and, as a result, there is a risk of damage to the casing 200.

Therefore, w % ben the fuse element 100 of the fuse 600 of the present invention is shaped bent toward the center O of the casing 200, the fuse part 120 is then disposed closer to the center O of the casing 200 than the inner wall 201 of the casing 200. Thus, the distance d2 between the fuse part 120 and the inner wall 201 can be secured so as to be larger than the distance d1 between the fuse part 120' and the inner wall 201, and an arc generated by the fuse part 120 reaches the inner wall 201 of the casing 200 and, as a result, damage to the casing 200 can be prevented.

Furthermore, although a granular arc-extinguishing material X is packed inside the casing 200, generally speaking, the arc-extinguishing material X collects readily with increasing proximity to the center O of the casing 200, and density tends to increase. That is, there is a tendency for the arc-extinguishing performance of the arc-extinguishing material X to increase with increasing proximity to the center O of the casing 200. Therefore, when the fuse element 100 of the fuse 600 of the present invention is shaped bent toward the center O of the casing 200, the fuse parts 120 are then arranged near the center O of the casing 200 and an arc generated by a fuse part 120 can be effectively extinguished by the arc-extinguishing material X. Note that the arc-extinguishing material X is not limited to granular form and that arc-extinguishing material in any form can be used.

In addition, the fuse parts 120 of the fuse element 100 are provided to each of the first flat surface 140 and second flat surface 150 such that the bent section 131 is sandwiched between the fuse parts. More specifically, as illustrated in FIGS. 1 and 2, the fuse part 120*a* is provided to the second flat surface 150 and the fuse parts 120*b*, 120*c*, and 120*d* are each provided to the first flat surface 140 such that the bent section 131 is sandwiched between the fuse parts. In addition, the bent section 131 of the fuse element 100 is disposed toward the center O of the casing 200 and hence the fuse parts 120, which are provided to each of the first flat surface 140 and second flat surface 150 such that the bent section 131 is sandwiched between the fuse parts, can approach the center O of the casing 200. As a result, an arc generated by a fuse part 120 can be extinguished effectively by the arc-extinguishing material X.

Note that, as illustrated in FIG. 1(*d*), the first flat surface 140 and second flat surface 150 are arranged displaced laterally from the center of the fuse element 100, and the first flat surface 140 and second flat surface 150 are arranged displaced above the terminal part 110 due to the step part 111. Hence, each of the fuse elements 100 which have vertically and horizontally inverted orientations as illustrated in FIG. 5 do not interfere with each other and can be housed in alignment around the center O in the casing 200.

Second Embodiment

A fuse 600A according to a second embodiment of the present invention will be described hereinbelow with reference to FIGS. 6 to 8. Note that the specific configuration of the fuse 600A is common to the fuse 600 according to the first embodiment, and hence a detailed description of the common configuration is omitted.

Figure 6A:
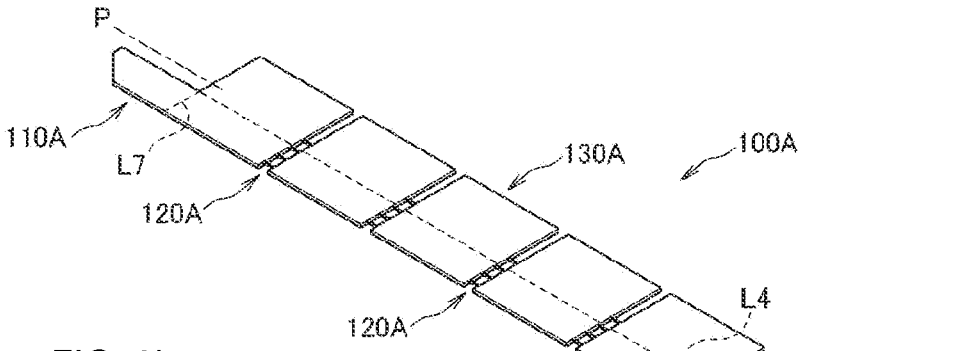
FIG. 6(*a*) is a perspective view of a state where a fuse element according to a second embodiment of the present invention is expanded.
Figure 6B:
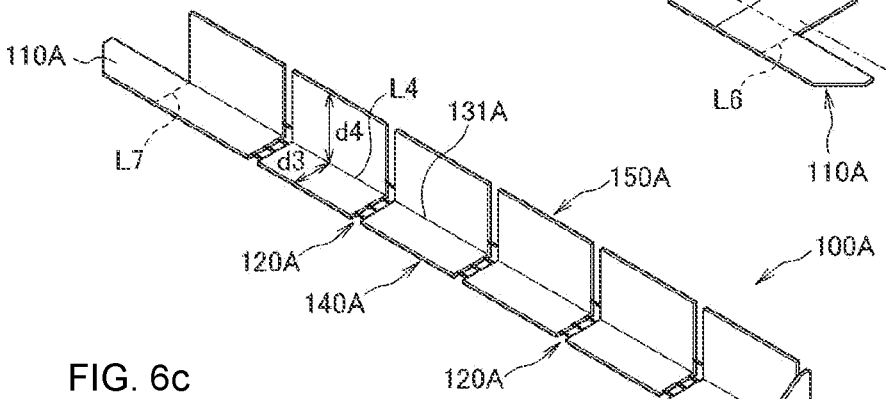
Figure 6C:
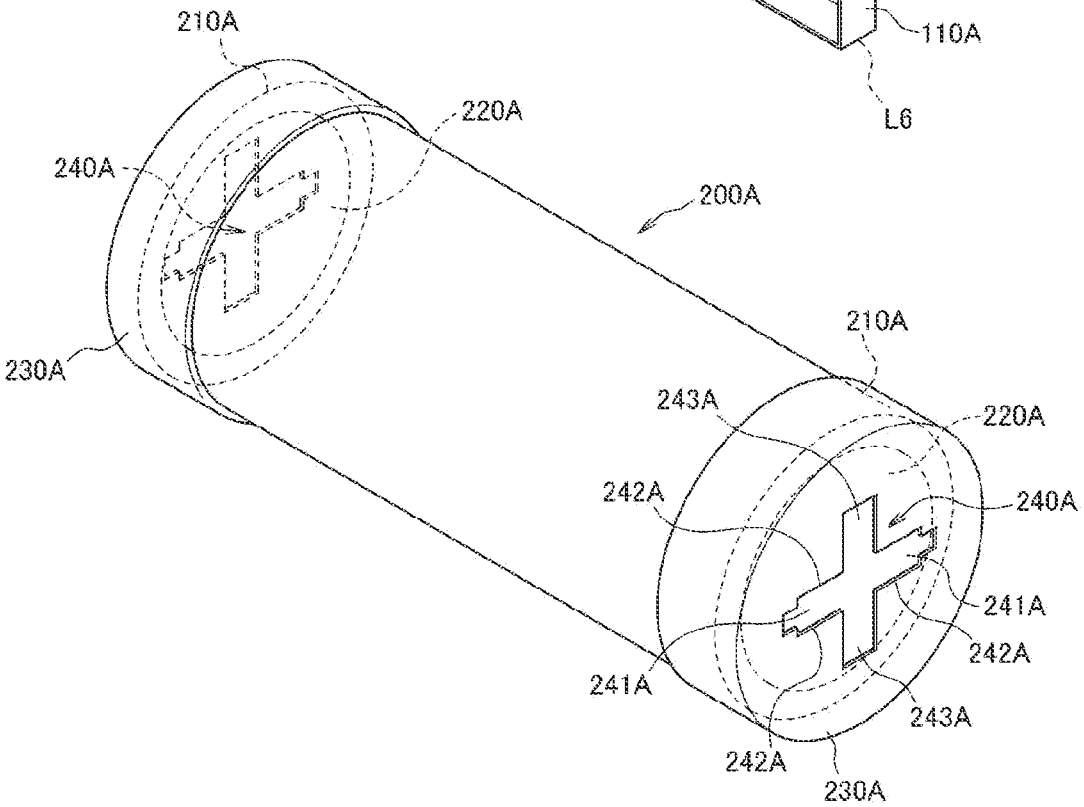

First, FIG. 6 illustrates the process of manufacturing a fuse element 100A of a fuse 600A according to a second embodiment of the present invention. Note that FIG. 6(*a*) is a perspective view of a state where a fuse element 100A is expanded; FIG. 6(*b*) is a perspective view of a state in which the fuse element 100A is molded bent; and FIG. 6(*c*) is an overall perspective view of a casing 200A for housing the fuse element 100A.

First, a flat plate of uniform thickness formed from a conductive metal such as copper or a copper alloy is stamped using a press machine or the like into the shape illustrated in FIG. 6(*a*). A metal plate which is afforded a predetermined shape as illustrated in FIG. 6(*a*) include a terminal part 110A at both ends, a flat middle section 130A between the terminal parts 110A, and a plurality of fuse parts 120A.

Next, as illustrated in FIG. 6(*b*), the middle section 130A is bent at a fold line L4 along the longitudinal direction P of the fuse element 100A. Thus, the middle section 130A includes a first flat surface 140A which extends along the longitudinal direction P and a second flat surface 150A which is bent so as to rise from the first flat surface 140A. The first flat surface 140A and the second flat surface 150A are contiguous to one other via a bent section 131A which is bent at the fold line L4, and the first flat surface 140A and the second flat surface 150A intersect substantially at right angles to one other. A state thus results where a plurality of fuse parts 120A are provided on the first flat surface 140A and the second flat surface 150A. Note that, in the case of the fuse element 100 according to the first embodiment illustrated in FIG. 1, the widths of the first flat surface 140 and the second flat surface 150 are substantially the same. However, the present invention is not limited to this configuration, the width d4 of the second flat surface 150A may be larger than the width d3 of the first flat surface 140A as illustrated in FIGS. 6(*a*) and 6(*b*).

Furthermore, because the middle section 130A of the fuse element 100A is constituted from a metal plate, the width d3 of the first flat surface 140A and the width d4 of the second flat surface 150A can be optionally changed as long as the bending point is changed by displacing the position of the fold line L4. In particular, when a change in the width d3 of the first flat surface 140A and the width d4 of the second flat surface 150A is desired in consideration of the balance of the fuse element 100A in the casing 200A, the shape is easily changed because the bending point can be changed by suitably displacing the position of the fold line L4.

Next, in order to house the fuse element 100A in the casing 200A illustrated in FIG. 6(*c*), one terminal part 110A of the fuse element 100A is bent substantially at right angles at a fold line L6. At this stage, the other terminal part 110A (in the drawing background) of the fuse element 100 is not bent substantially at right angles at a fold line L7. Note that the casing 200A has a cylindrical shape formed from ceramic or a synthetic resin, or the like, and includes an opening 220A in an end 210A on both sides. Further, an inner cap 230A, which is formed from a synthetic resin or the like, is attached to the end 210A so as to cover the opening 220A. A cross-shaped hole 240A is formed in the inner cap 230A. A step part 242A is formed in a first hole 241A arranged in a linear manner. Furthermore, a second hole 243A is formed so as to intersect the first hole 241A at right angles.

Next, a method for housing the fuse element 100A inside the casing 200A will be described with reference to FIGS. 7 and 8. Note that FIGS. 7(*a*) and 7(*b*) are overall perspective views of the casing 200A; FIGS. 8(*a*) and 8(*b*) are perspective views in which the region close to the end of the casing 200A is enlarged; and FIG. 8(*c*) is an overall perspective view of a finished fuse 600A.

Figure 7A:
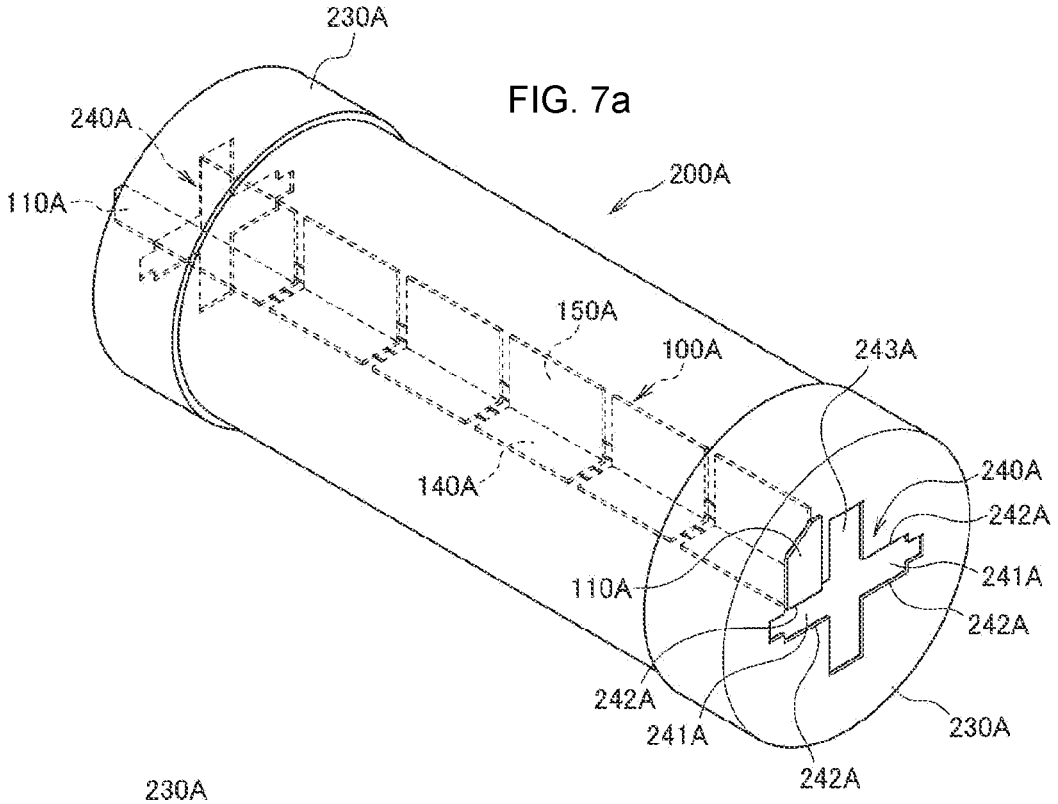
FIGS. 7(*a*) and 7(*b*) are overall perspective views of the casing according to the second embodiment of the present invention.
Figure 7B:
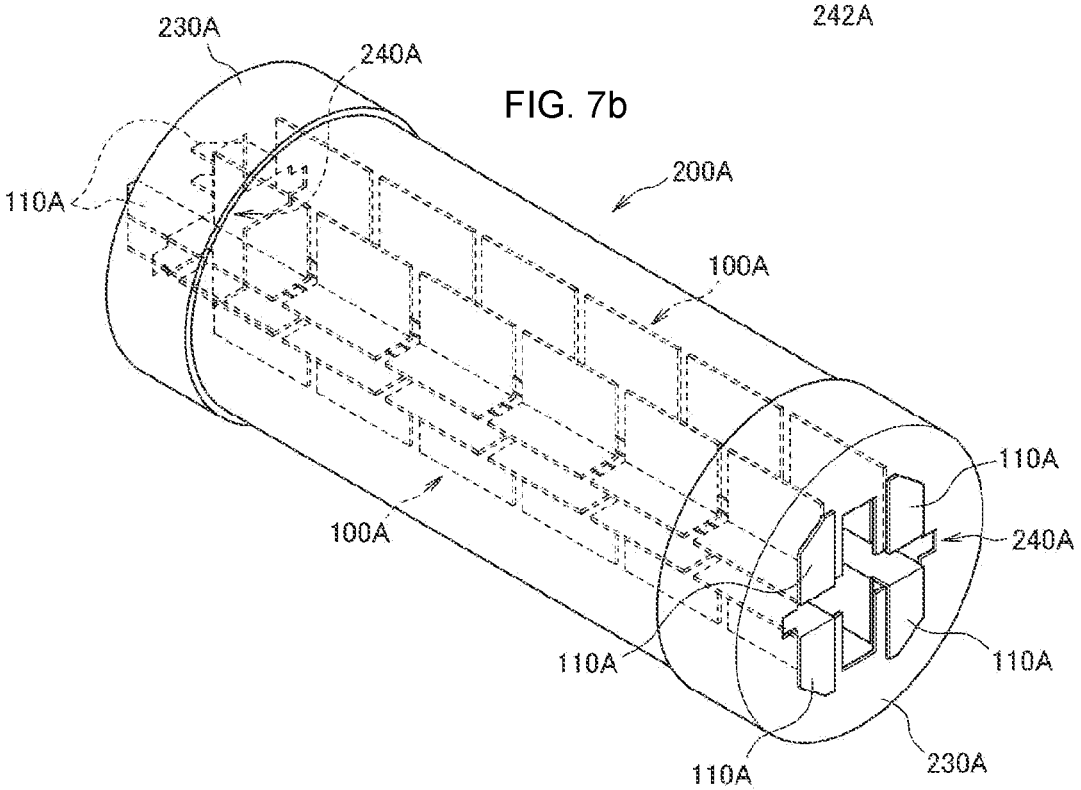

First, as illustrated in FIG. 7(*a*), the fuse element 100A is housed by being inserted inside the casing 200A via the cross-shaped hole 240A (in the drawing foreground) of one inner cap 230A. More specifically, the other terminal part 110A (in the drawing background) of the fuse element 100A is inserted via the cross-shaped hole 240A (in the drawing foreground) of the one inner cap 230A, and the fuse element 100A is inserted inside the casing 200A so that the first flat surface 140A of the fuse element 100A is made to pass through the first hole 241A and the second flat surface 150A of the fuse element 100A is made to pass through the second hole 243A. Further, the terminal part 110A is made to engage with the step part 242A of the first hole 241A, and a point of contact between the inner cap 230A and the terminal part 110A is fixed through welding or the like.

Using the same method, the other three fuse elements 100A are also inserted into the casing 200A via the cross-shaped hole 240A and the terminal part 110A is made to engage with the step part 242A of the first hole 241A. Further, as illustrated in FIG. 7(*b*), the point of contact between the inner cap 230A and each terminal part 110A is fixed through welding or the like.

Figure 8A:
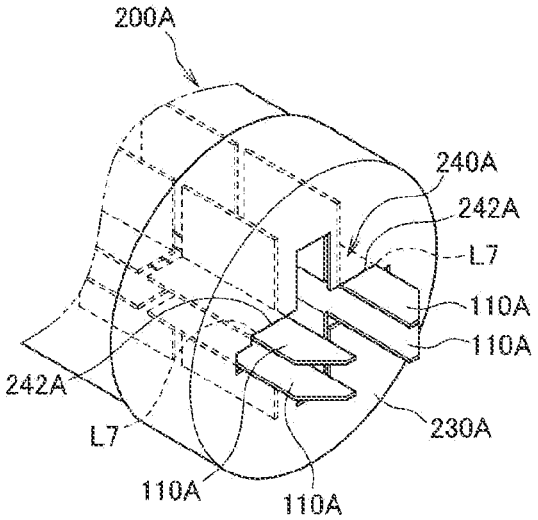
FIGS. 8(*a*) and 8(*b*) are perspective views in which the region close to the end of the casing according to the second embodiment of the present invention is enlarged.
Figure 8B:
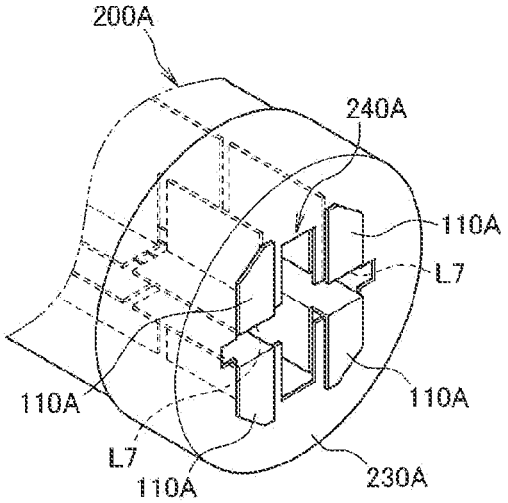
Figure 8C:
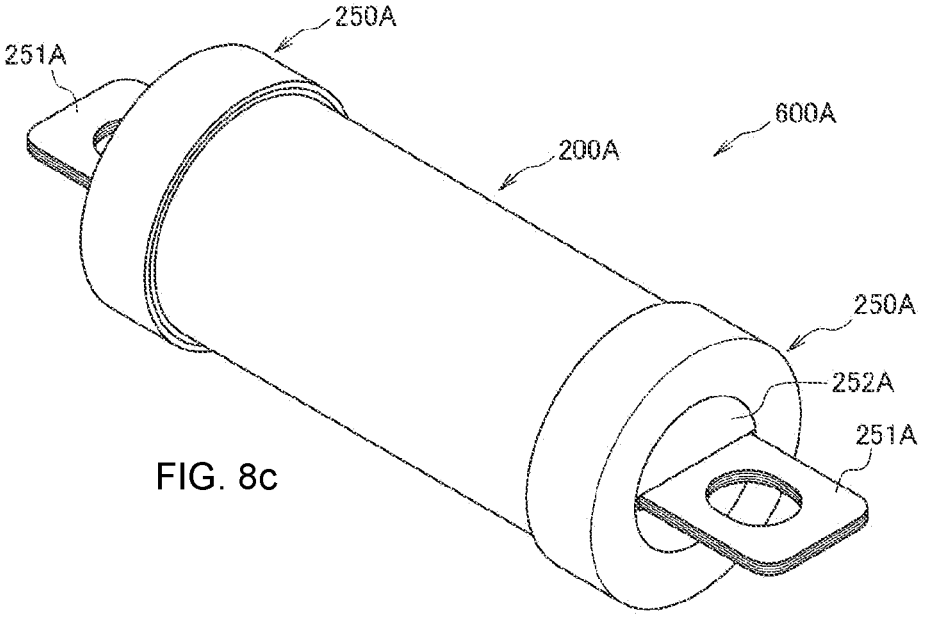

The other terminal part 110A (in the drawing background) of the fuse element 100A is in a state of not yet being bent and hence, as illustrated in FIG. 8, each terminal part 110A can be inserted firmly as far as the cross-shaped hole 240A of the other inner cap 230A. Note that, in FIGS. 8(*a*) and 8(*b*), the other terminal part 110A (in the drawing background) illustrated in FIG. 7 is displayed in the foreground. Each terminal part 110A is then bent at right angles at fold line L7, made to engage with the step part 242A of the cross-shaped hole 240A, and the point of contact between the inner cap 230A and the terminal parts 110A is fixed through welding or the like.

An outer cap 250 is attached by being press-fitted from above one inner cap 230A, thereby closing one cross-shaped hole 240A, and a granular arc-extinguishing material flows into the casing 200A via the cross-shaped hole 240A of the other inner cap 230A. Further, once the interior of the casing 200A has been filled with arc-extinguishing material, if an outer cap 250A is press-fitted from above the other inner cap 230A, thereby closing the other cross-shaped hole 240A, the fuse 600A is finished. The outer cap 250A includes an outer terminal part 252 made of metal for connecting to an electric circuit, and a disc-like base part 252A made of metal which is coupled to the outer terminal part 252, and the back face of the base part 252A makes contact with the terminal part 110A so as to be electrically connected thereto. Hence, the fuse 600A is used such that, when an unintended overcurrent flows in an electric circuit or the like which is connected to the outer terminal part 252, the fuse part 120A of the fuse element 100A melts and interrupts the overcurrent, thereby protecting the electric circuit.

Note that, according to the configurations of the fuse 600 illustrated in FIGS. 7 and 8, because the cross-shaped hole 240A through which arc-extinguishing material flows into the casing 200A is completely closed by the outer cap 250A, leakage of arc-extinguishing material from the casing 200A can be effectively prevented.

Note that the fuse of the present invention is not limited to the foregoing embodiment examples, rather, various modification examples and combinations are possible within the scope of the patent claims and the scope of the embodiment, and such modification examples and combinations are also included in the scope of rights thereof.

The invention claimed is:

1. A fuse, comprising:

a plurality of fuse elements comprising:

a pair of terminal parts and a plurality of fuse parts; and a casing for housing the fuse parts;

wherein each fuse part further comprises a first flat surface and a second flat surface contiguous with each other and intersecting a fold line along a longitudinal direction of the fuse element; and a first interconnection having a narrower width than each fuse part disposed contiguous between respective first flat surfaces and a second interconnection having a narrower width than each fuse part disposed between respective second flat surfaces; and wherein the fold line is parallel to an axis between the pair of terminal parts and disposed offset from the axis in a first direction and disposed offset from the axis in a second direction orthogonal to the first direction;

wherein the terminal parts of one of the plurality of fuse elements are stacked on terminal parts of another of the plurality of fuse elements, and the axis between the pair of terminal parts of the one fuse element is stacked on the axis between the pair of terminal parts of the another fuse element; and wherein for each of the plurality of fuse elements, the first flat surface and the second flat surface are arranged only on one side in the first direction from the axis between the pair of terminal parts and only on one side in the second direction from the axis, respectively.

2. The fuse according to claim 1, wherein each fuse element is bent toward the center of the casing.

3. The fuse according to claim 2, wherein each fuse part further comprises the first flat surface and the second flat surface orthogonal to each other.

4. The fuse according to claim 1, wherein each fuse element is constituted from a flat metal plate; and wherein the first flat surfaces and the second flat surfaces are formed by being bent along the longitudinal direction of the fuse element.

5. The fuse according to claim 2, wherein each fuse element is constituted from a flat metal plate; and wherein the first flat surfaces and the second flat surfaces are formed by being bent along the longitudinal direction of the fuse element.

6. The fuse according to claim 3, wherein the fuse element is constituted from a flat metal plate; and wherein the first flat surface and the second flat surface are formed by being bent along the longitudinal direction of the fuse element.

7. A fuse, comprising:

a plurality of fuse elements, each fuse element comprising:

a pair of terminal parts;

a plurality of respective fuse parts disposed isolated from respective fuse parts of any other fuse element; and a casing for housing the fuse parts;

wherein each respective fuse part for a respective fuse element further comprises a first flat surface and a second flat surface contiguous with each other and intersecting a fold line along a longitudinal direction of the fuse element;

wherein the fold line is parallel to an axis between the pair of terminal parts and disposed offset from the axis in a first direction and disposed offset from the axis in a second direction orthogonal to the first direction;

wherein terminal parts of one of the plurality of fuse elements are stacked on terminal parts of another of the plurality of fuse elements, and the axis between the pair of terminal parts of the one fuse element is stacked on the axis between the pair of terminal parts of the another fuse element; and wherein for each of the plurality of fuse elements, the first flat surface and the second flat surface are arranged only on one side in the first direction from the axis between the pair of terminal parts and only on one side in the second direction from the axis, respectively.

8. The fuse according to claim 7, wherein each fuse element is arranged in a vertical or horizontal inverted position so that the first flat surface and the second flat surface of one fuse element are spaced from and do not interfere with the first flat surface and the second flat surface of another fuse element, respectively.

9. A fuse, comprising:

four fuse elements, each fuse element comprising a pair of terminal parts and a plurality of respective fuse parts isolated from respective fuse parts of any other fuse element; and a casing for housing the fuse parts;

wherein each respective fuse part for a respective fuse element further comprises a first flat surface and a second flat surface contiguous with each other and intersecting a fold line along a longitudinal direction of the fuse element;

wherein the four fuse elements are rotated 90 degrees with respect to each other and are stacked on top of each other;

wherein terminal parts of one of the four fuse elements are stacked on terminal parts of another of the four fuse elements, and an axis between the pair of terminal parts of the one fuse element is stacked on an axis between the pair of terminal parts of the another fuse element; and wherein strips of fuse parts of the fuse elements are offset with respect to the stacked terminal parts and are also offset with respect to a longitudinal axis of the fuse.

10. A fuse according to claim 9, wherein for each of the fuse elements, the first flat surface and the second flat surface are arranged only on one side in a first direction from an axis between the pair of terminal parts and only on one side in a second direction from the axis, respectively.

* * * * *